US005178996A

United States Patent [19]

Kobayashi et al.

[11] Patent Number: 5,178,996

[45] Date of Patent: Jan. 12, 1993

[54] METHOD OF MAKING PHOTOGRAPHIC ELEMENT HAVING EPOXY OVERLAYER

[75] Inventors: Tohru Kobayashi; Yasuo Nishi; Nakaya Nakano, all of Hino; Kazuo Ohkawa; Hiroyuki Tachikawa, both of Tokyo, all of Japan

[73] Assignees: Konica Corporation, Tokyo; Asahi Denka Kogyo K.K., Tokyo, both of Japan

[21] Appl. No.: 897,578

[22] Filed: Jun. 11, 1992

Related U.S. Application Data

[63] Continuation of Ser. No. 670,371, Mar. 14, 1991, abandoned, which is a continuation of Ser. No. 458,303, Dec. 28, 1989, abandoned.

[30] Foreign Application Priority Data

Dec. 29, 1988 [JP] Japan ..... 63-335608

[51] Int. Cl.[5] ..... G03C 1/76

[52] U.S. Cl. ..... 430/532; 427/331; 430/271; 430/273; 430/523; 430/531; 430/961

[58] Field of Search ..... 430/271, 273, 523, 531, 430/532, 961; 427/331

[56] References Cited

U.S. PATENT DOCUMENTS

| | | | |
|---|---|---|---|
| 4,082,634 | 4/1978 | Chang | 430/906 |
| 4,092,173 | 5/1978 | Novak et al. | 96/119 R |
| 4,130,708 | 12/1978 | Friedlander et al. | 528/28 |
| 4,171,979 | 10/1979 | Novak et al. | 96/119 R |
| 4,248,959 | 2/1981 | Faust | 430/906 |
| 4,333,998 | 6/1982 | Leszyk | 430/523 |
| 4,426,431 | 1/1984 | Harasta et al. | |

FOREIGN PATENT DOCUMENTS

| | | |
|---|---|---|
| 57-90789A | 5/1982 | Japan . |
| 62-21150 | 1/1987 | Japan . |
| 62-23042 | 1/1987 | Japan . |
| 62-23043 | 1/1987 | Japan . |
| 62-24256 | 2/1987 | Japan . |
| 62-25758 | 2/1987 | Japan . |
| 62-229133 | 10/1987 | Japan . |

OTHER PUBLICATIONS

Patents Abstracts of Japan, vol. 11, No. 201 (P-500) (2648) Jun. 30, 1987 & JP-A-62 021 150 (Konishiroku Photo Industry Co. Ltd.) Jan. 29, 1987 *abstract*.

Ronald S. Bauer (ed) "Epoxy Resin Chemistry" 1981, American Chemical Society, Washington US *Chapter 2, "Photosensitized epoxides as basis for light-curable coatings", pp. 17-45, especially p. 40, lines 1-6*.

*Primary Examiner*—Jack P. Brammer

*Attorney, Agent, or Firm*—Frishauf, Holtz, Goodman & Woodward

[57] ABSTRACT

Disclosed is a photographic element having a support, at least one layer for carrying an image on the support and a protective coated layer cured by an active energy ray thereon, wherein the protective coated layer is one obtained by curing, by irradiation of an active energy ray, an active energy ray curable composition containing a prepolymer containing at least 2 epoxy groups in the molecule and a polymerization initiator which can be activated by the active energy ray; and the active energy ray curable composition is coated on the layer carrying the image; and the layer carrying the image has a water content of 20.0% by weight or less. Disclosed is also a process for preparing the photographic element constituted as the above.

9 Claims, 1 Drawing Sheet

METHOD OF MAKING PHOTOGRAPHIC ELEMENT HAVING EPOXY OVERLAYER

This application is a continuation of application Ser. No. 07/670,371, filed Mar. 14, 1991, which is a continuation of application Ser. No. 07/458,303 filed Dec. 28, 1989.

BACKGROUND OF THE INVENTION

This invention relates to a photographic element having a support, at least one layer for carrying images on the support and also a protective coating layer, and a process for producing the same. More particularly, it pertains to a photographic element which can be prepared easily, and is excellent in adhesion to the layer forming the image and excellent in water resistance. The photographic element of the present invention can be utilized well particularly for, for example, identification card.

As the so-called ID card, such as employee certificate, credit card, driver license, passage admittance, there have been generally employed those having predetermined necessary informations, for example, particulars (informations) such as address, name, number on a support such as paper, plastic, etc. by printing, etc., and also identification informations such as photograph, etc. for identifying the person, applied with seal. However, this kind of identification card has the problem that falsifying such as forging, modification, etc. can be easily done. Also, these were weak in durability such as with friction, etc. and frequently suffered from contamination, breaking, etc. when carried at all times. As an improvement of such defect, recently used is made of a light-sensitive material having a light-sensitive emulsion such as silver halide emulsion coated on a support, and particulars are printed on said light-sensitive material and also a face picture of person is printed thereon. There have been also known those with various contrivances for prevention of falsifying, for example, one having the surface of a card coated with a resin film followed by hot seal, one having both surfaces of said card laminated with a resin film, etc. However, these can be also modified by peeling off the emulsion surface and the resin film of the light-sensitive material, thus proving to be no complete prevention of falsifying, and besides there has been the fear of discoloration, thus posing a problem in durability. Further, those adhered or laminated onto a resin film suffered from problems that complicated devices such as hot melting device, lamination device and complicated steps are required, whereby no inexpensive ID card can be obtained.

As the method for solving these, there has been known the technique in which an active energy curable composition is applied on the image forming layer, and then said composition is cured with an active energy ray to form a protective coating layer.

As the method for obtaining a protective layer by curing with an active energy ray, there have been known the techniques for providing UV-ray curable protective coating layers for the purpose of imparting scratching resistance, abrasion resistance, blooming resistance, etc. to the photographic material after formation of image. For example, in Japanese Unexamined Patent Publication No. 57023/1978, U.S. Pat. Nos. 4,171,979, 4,049,861 and 4,333,998, Japanese Unexamined Patent Publications Nos. 121100/1978 and 91233/1981 and Japanese Unexamined PCT Patent Publication No. 501642/1984, there are disclosed the method in which a composition containing an acrylic prepolymer having unsaturated groups and a polymerization initiator generating photoradicals is coated to effect curing by way of radical polymerization, and the technique in which curing is effected by using in combination an epoxy resin, an acrylic prepolymer, a cation polymerization initiator and a radical polymerization initiator. However, these protective layers, although having sufficient performances in improvement of abrasion of films for projection and in handling of print films, are entirely unsatisfactory when this technique is applied to ID card, and the characteristics demanded in ID card, particularly water resistance and adhesion, cannot be obtained sufficiently.

More specifically, when an active energy ray curable resin is to be used as the protective layer on a silver halide photographic emulsion, the problem will generally occur in acrylic polymers in adhesion to the emulsion layer, requiring sometimes an intermediate layer. As the technique for improving the adhesion, there have been disclosed methods in which acrylate oligomers, and compounds having reactivity with or affinity for gelatin are used in combination in Japanese Unexamined Patent Publications Nos. 201248/1986, 201250/1986, 201249/1986, 201251/1986, but although there may be the effect of improvement of adhesion, it is still insufficient, and also light resistance is not sufficient, thus being not necessarily satisfactory in photographic performances. On the other hand, in the case of the epoxy type polymer, it has been found that the problem may sometimes occur with respect to its curability on account of sodium sulfite.

Examples of using curable coating layers coated with compositions containing epoxy resins and cation polymerization initiators for ID card are disclosed in Japanese Unexamined Patent Publications Nos. 90789/1982, 21150/1987, 23042/1987, 23043/1987, 24256/1987, 25758/1987 and 29133/1987. However, under various conditions where ID card is used, it is impossible to satisfy all of necessary adhesion, water resistance, pinhole characteristic, contamination resistance when damaged, and a very great curing device is required for satisfying all of these according to the techniques listed above and it is difficult to prepare simply an inexpensive card.

Also, as the technique for improving adhesion by use of an acrylate oligomer and an epoxy type polymer, Japanese Unexamined Patent Publications No. 229133/1987 discloses the technique of using a specific film hardener in the layer adjacent to the UV-ray curable layer, and its effect is greater as the amount of the film hardener used is larger, but there is the problem that the photographic sensitivity will be lowered in that case.

SUMMARY OF THE INVENTION

The present invention has been accomplished in view of the various problems as described above, and its object is to provide a photographic element of which the protective coating layer is formed by active energy ray curing, namely firstly a photographic element having good adhesion of the image forming layer, etc. as well as good water resistance, and secondly a photographic element which can give satisfactory images having good adhesion and water resistance, and without damaging light resistance and sensitivity. Also, its object is to provide a preparation process which can form such photographic element simply and inexpensively by active energy ray irradiation of low energy.

The above objects of the present invention have been accomplished in a photographic element having at least one layer for carrying image and a protective coating layer cured with active energy ray on a support and a process for preparing the same, by employing the technical means in which the protective coating layer is made one curable by irradiation of an active energy ray curable composition containing a prepolymer containing at least 2 epoxy groups in the molecule and a polymerization initiator activated by an active energy ray, and the water content in the layer carrying said image before coating of said active energy ray curable composition is made 20.0 % by weight or lower.

According to the above means, a photographic element in which good adhesion and water resistance, as well as good photographic performances (images), which had been both difficultly accomplished in the prior art, are both satisfactory could be obtained. According to the present invention, it is not necessarily required to make the temperature of the curable composition during energy ray irradiation for making better adhesion.

DESCRIPTION OF THE PREFERRED EMBODIMENTS

Figure 1:
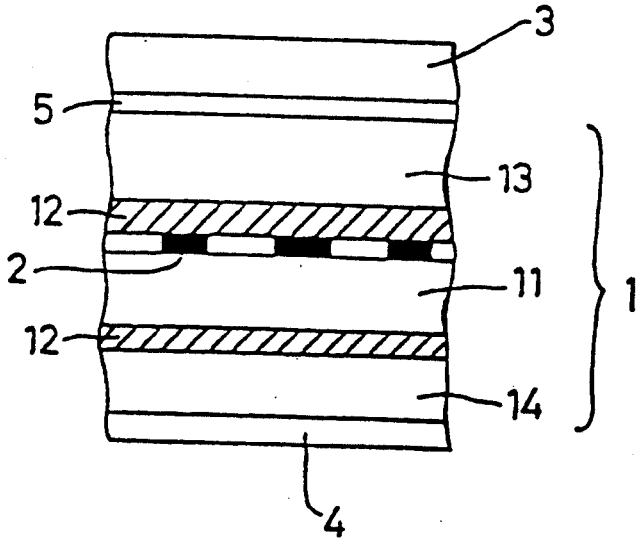
FIG. 1 shows a sectional view of an example of the photographic element prepared in Example.

The photographic element according to the present invention has at least one layer for carrying image and a protective coating layer cured with an active energy on a support.

Such photographic element can be obtained by forming a protective coating layer cured with an active energy ray on one having at least one layer for carrying image on a support (herein, this is called as "image member", for example, photographic material having an image obtained by exposure and development, etc.).

The above protective coating layer formed on an image member should be preferably formed as the layer remotest from the support. However, on the side still farther from the support than said protective coating layer, namely on the outside, further an overcoat, another protective layer, or a laminated layer, etc. may be also formed.

In the present invention, the protective coating layer of the photographic element is formed by irradiating active energy ray to cure an active energy curable composition containing a prepolymer containing at least 2 epoxy groups in the molecule and a polymerization initiator activated with an active energy ray. However, the water content in the layer carrying the above-mentioned image before coating of the energy ray curable composition is 20.0% by weight or less.

As the active energy ray curable composition for formation of such protective coating layer which can be used in the present invention, resin compositions curable with various active energy rays (e.g. U.V.-ray and other radiations) can be used. Specific compositions are to be described and exemplified later.

In the present invention, the temperature of the curable composition during irradiation of active energy ray may be any desired one, for example, normal temperature of 18° C., 20° C. or 23° C., or it may be also controlled to a temperature of 30° to 100° C.

In the present invention, the water content in the layer for carrying image on the above image member before coating of the active energy ray curable composition is 20.0% by weight or less. In the present specification, the water content is determined from the following formula, if the weight of the layer carrying the image in a sample is defined as $W_w$, and the weight of the layer carrying said image after removal of the water content from the layer carrying the image by drying of the sample as $W_d$:

$$\text{Water content (wt. \%)} = \{(W_w - W_d)/W_w\} \times 100.$$

The "samples" mentioned above are image members before coating of the active energy ray curable composition and after controlled the water content.

Specifically, the water content can be measured by use of a conventional IR-ray water meter (e.g. table type digital water meter IRAM 110, manufactured by CHINO Seisakusho), etc.

For controlling the water content within this range, there are various means, and any of them can be used as desired. More specifically, in practicing the present invention, any means may be available for control of the water content, but the means of controlling the water content by exposing the layer carrying image to adequate temperature and humidity conditions is easily feasible in operation. This applies the facts well known in this field of art that the water content in said layer greatly changes depending on the properties of the binder in the layer carrying the image, and that the water content, which also changes depending on the binder and its amount used in the layer carrying the image, greatly changes particularly depending on the temperature and humidity conditions to which the layer carrying the image is exposed. More specifically, the water content can be controlled by the method in which relative humidity is changed by changing the dew point of the wind for exposure, the method in which relative humidity is changed by changing the temperature of the wind, and also the method in which the water content is changed by heating once the layer carrying the image.

In the present invention, when a UV-ray curable composition is used as the active energy ray curable composition, as the light source for irradiated light in the UV-ray region (herein also called merely as UV-ray), there may be included sunlight, low pressure mercury lamp, high pressure mercury lamp, ultra-high pressure mercury lamp, carbon arc lamp, metal halide lamp, xenon lamp, etc.

The atmosphere during irradiation of UV-ray may be either air, or alternatively an inert gas such as nitrogen gas, carbon dioxide, etc.

The irradiation time of UV-ray on the UV-ray curable composition which can be used in the present invention may also depend on the light source for irradiation in the UV-ray region as mentioned above, but preferably approximately 0.5 second to 5 minutes, more preferably 3 seconds to 2 minutes.

Ordinarily, a larger scale light source with larger irradiation intensity is required when the irradiation time is shorter, while one with smaller irradiation intensity can be used when the irradiation time is longer, but the latter is disadvantageous in preparation steps, because the curing action time becomes longer. However, according to the present invention, the objects can be advantageously accomplished by irradiation of 3 seconds to 2 minutes by use of a UV-ray generating lamp of 200 W or lower.

Having described above by referring to UV-ray curable resin composition as an example, other active energy ray curable resin compositions can be also used according to the properties of the respective active energy rays and the compositions.

Such resin composition can be coated as liquid resin base material on a support, for example, the outermost layer (e.g. image forming layer) on a support shaped in band. For coating of liquid resin base material on the layer surface, it is possible to use a conventional coating means such as double roll coater, gravure offset coater, slit coater, air knife coater, wire bar coater, slide hopper, spray coating, etc., and, for example, the image member surface shaped in card can be simply coated by these methods. The coating thickness at this time may be any desired one, but suitably about 0.1 $\mu$ to 30 $\mu$, preferably 1 $\mu$ to 15 $\mu$.

The prepolymer including at least two epoxy groups in the molecule which is the constituent element in the energy ray curable composition to be used in the present invention is an epoxy resin which is formed into a polymer or crosslinked by irradiation of an energy ray in the presence of a polymerization initiator which is activated by the active energy ray. Examples of such resin may include aromatic epoxy resins, alicyclic resins, aliphatic epoxy resins known in the art, which can be used as desired either singly or in combination. In preferable embodiments of the present invention, each one kind of aromatic epoxy resins, alicyclic epoxy resins and aliphatic epoxy resins are used in combination.

Here, preferable aromatic epoxy resins are polyglycidyl ethers of polyhydric phenols or alkylene oxide adducts thereof, including glycidyl ethers and epoxy novolac resins prepared by the reaction between bisphenols or alkylene oxide adducts and epichlorohydrin.

Preferable alicyclic epoxy resins may include polyglycidyl ethers of polyhydric alcohols having at least two alicyclic rings or cyclohexane oxide or cyclopentene oxide-containing compounds obtained by epoxidization of cyclohexene or cyclopentene ring containing compounds with a suitable oxidizing agent such as hydrogen peroxide, peracid, etc.

Representative examples of alicyclic epoxy resins may include hydrogenated bisphenol A diglycidyl ether, 3,4-epoxycyclohexylmethyl-3,4-epoxycyclohexane carboxylate, 2-(3,4-epoxycyclohexyl-5,5-spiro-3,4-epoxy)cyclohexanemethadioxane, bis(3,4-epoxycyclohexylmethyl)adipate, vinylcyclohexene dioxide, bis(3,4-epoxy-6-methylcyclohexylmethyl)adipate, 3,4-epoxy-6-methylcyclohexyl-3,4-epoxy-6-methylcyclohexane carboxylate, methylenebis(3,4-epoxycyclohexane)dicyclopentadiene diepoxide, di(3,4-epoxycyclohexylmethyl)ether of ethylene glycol, ethylenebis(3,4-epoxycyclohexane carboxylate), dicyclopentadiene epoxide, etc.

Further, preferable of aliphatic epoxy resins are polyglycidyl ethers of aliphatic polyhydric alcohols or alkylene oxide adducts thereof and homopolymers and copolymers of polyglycidyl esters, glycidyl acrylates or glycidyl methacrylates of aliphatic long chain polybasic acids. Representative examples of them may include glycidyl ether of 1,4-butane diol, diglycidyl ether of 1,6-hexane diol, triglycidyl ether of glycerine, triglycidyl ether of trimethylol propane, polyglycidyl ether of sorbitol, diglycidyl ether of polyethylene glycol, diglycidyl ether of polypropylene glycol, polyglycidyl ethers of polyether polyols obtained by adding one or two or more kinds of alkylene oxides to aliphatic polyhydric alcohols such as ethylene glycol, propylene glycol, glycerine, etc., diglycidyl esters of aliphatic long chain dibasic acids, epoxidized polybutadiene, etc.

In the prepolymer containing at least two epoxy groups in the molecule which is the constituent element in the energy ray curable composition to be used in the present invention, monoepoxide or cation polymerizable organic substance other than epoxy resin can be used as formulated depending on the desired performances.

For example, as examples of the monoepoxide which can be used, there may be included monoglycidyl ethers of fatty higher alcohols, or monoglycidyl ethers of phenol, cresol, butylphenol, or polyether alcohols obtained by addition of alkylene oxides to these, glycidyl esters of higher fatty acids, epoxidized soybean oil, butyl epoxystearate, octyl epoxystearate, epoxidized linseed oil, etc.

Examples of cation polymerizable organic substance may include oxetane compounds such as trimethylene oxide, 3,3-dimethyloxetane, 3,3-dichloromethyloxetane, etc.; oxorane compounds such as tetrahydrofuran and 2,3-dimethyltetrahydrofuran; cyclic acetal compounds such as trioxane, 1,3-dioxorane and 1,3,6-trioxanecyclooctane; cyclic lactone compounds such as $\beta$-propiolactone and $\epsilon$-caprolactone; thyrane compounds such as ethylene sulfide, 1,2-propylene sulfide and thioepichlorohydrin; thiethane compounds such as 1,3-propylene sulfide and 3,3-dimethylethane; vinyl ether compounds such as ethylene glycol divinyl ether, polyalkylene glycol divinyl ether, alkyl vinyl ether and 3,4-dihydropyrane-2-methyl(3,4-dihydropyrane-2-carboxylate); spiro-ortho-ester compounds obtained by the reaction between epoxy compounds and lactone; ethylenically unsaturated compounds such as vinylcyclohexane, isobutylene and polybutadiene; and the derivatives of the above-mentioned compounds.

As the polymerization initiator which can be activated by active energy ray, a compound which can liberate a substance capable of initiating cation polymerization by irradiation of an energy ray can be used, and particularly preferable are a group of complex salts which are onium salts liberating Lewis acid having polymerization initiation ability by irradiation.

Representative examples of such compound may be represented by the formula:

$$[R^1{}_aR^2{}_bR^3{}_cR^4{}_dZ]^{+m}[MX_{n+m}]^{-m}$$

[wherein cation is onium; Z is S, Se, Te, P, As, Sb, Bi, O, a halogen (e.g. I, Br, Cl) or N=N; $R^1$, $R^2$, $R^3$ and $R^4$ are organic groups which may be either identical or different; a, b, c and d are each integer of 0 to 3, and a+b+c+d is equal to the valence of Z; M is a metal or a metalloid which is the center atom of the halide complex, including B, P, As, Sb, Fe, Sn, Bi, Al, Ca, In, Ti, Zn, Sc, V, Cr, Mn, Co, etc.; X is a halogen; m is the net charges of the halide complex ion; and n is the number of halogen atoms in the halide complex ion].

Specific examples of the anion $MX_{n+m}$ in the above formula may include tetrafluoroborate ($BF_4^-$), hexafluorophosphate ($PF_6^-$), hexafluoroantimonate ($SbF_6^-$), hexafluoroarsenate ($AsF_6^-$), hexachloroantimonate ($SbCl_6^-$), etc.

Further, anions of the formula $MX_n(OH)^-$ can be also employed. Also, as other anions, perchlorate ion ($ClO_4^-$), trifluoromethyl sulfite ion ($CF_3SO_3^-$), fluorosulfonic acid ion ($FSO_3^-$), toluenesulfonic acid anion, trinitrobenzenesulfonic acid anion, etc. may be included.

Among such onium salts, it is particularly effective to use an aromatic onium salt as the cation polymerization initiator, and among them, there may be included aromatic halonium salts as disclosed in Japanese Unexamined Patent Publications Nos. 151996/1975, 158680/1975, etc; the group VIa aromatic onium salts as disclosed in Japanese Unexamined Patent Publications Nos. 151997/1975, 30899/1977, 55420/1981, 125105/1980, etc.; the group Va aromatic onium salts as disclosed in Japanese Unexamined Patent Publication No. 158698/1975; oxosulfoxonium salts as disclosed in Japanese Unexamined Patent Publications Nos. 8428/1981, 149402/1981, 192429/1982, etc.; aromatic diazonium salts as disclosed in Japanese Patent Publication No. 17040/1974, etc.; thiopyrilium salts as disclosed in U.S. Pat. No. 4,139,655, etc.; and so on. Also, aluminum complex/photopolymerizable silicon compound type initiators, etc. may be included.

For such cation polymerization initiators, photosensitizers such as benzophenone, benzoin isopropyl ether, thioxanthone, etc. can be also used in combination.

In the active energy ray curable composition to be used in the present invention, the polymerization initiator is generally contained in an amount preferably of 0.1 to 15 parts by weight, more preferably 1 to 10 parts by weight based on 100 parts by weight of the energy ray curable prepolymer.

The active energy ray curable composition which can be used in the present invention can be used with formulation of a suitable amount of radical polymerizable organic substances other than the prepolymer as described above, heat-sensitive polymerization initiators, colorants such as pigments, dyes, etc., various resin additives such as defoaming agents, thickeners, leveling agents, flame retardants, UV-ray absorbers, antioxidants, etc., fillers, resins for modification, etc. As radical polymerizable organic substances, there may be included, for example, acrylate type resins such as epoxy acrylate, urethane acrylate, polyester acrylate, polyether acrylate, etc. As heat-sensitive polymerization initiators, aliphatic onium salts as disclosed in Japanese Unexamined Patent Publications Nos. 49613/1982 and 37004/1983, may be included.

According to the present invention, it is not necessary at all to provide newly a subbing layer or apply surface treatment of the image forming layer, etc. between the farthest layer from the support (e.g. image forming layer) and the protective layer curable with active energy ray such as UV-ray for supplementing adhesion.

As the support or substrate of the photographic element according to the present invention, both opaque and transparent supports are available. For example, paper, laminated paper having polyethylene laminated on paper, support for photography obtained by coating of electron beam curable composition containing white pigment on the surface of paper followed by curing with electron beam, synthetic resin sheet, etc. can be used.

Particularly, from aspect in image storability, a reflective support having an oxygen permeability of the support of 2.0 $ml/m^2 \cdot hr \cdot atm$ or less, more preferably, 1.0 $ml/m^2 \cdot hr \cdot atm$ is desirable. Further, as the suitable support including also aspects of adequate hardness and handling, there may be included, for example, homopolymers and copolymers such as of polyesters, vinyl alcohol, vinyl chloride, fluorinated vinyl, vinyl acetate, etc., homopolymers and copolymers such as of cellulose acetate, acrylonitrile, alkyl acrylate, alkyl methacrylate, methacrylonitrile, alkyl vinyl ester, alkyl vinyl ether, polyamide, etc., and films having these polymers laminated thereon, etc.

Among these films, particularly preferable is polyester, laminated film of polyester and polyethylene and laminated paper. Further, polyester film has preferably the same oxygen permeability during highly humid time as during dry time, because oxygen permeability has no dependence on humidity.

Also for imparting reflectivity to said support, a white pigment may be contained or a hydrophilic colloidal layer containing a white pigment may be provided by coating.

As the white pigment, inorganic and/or organic pigments may be included, preferably inorganic white pigments. Examples of such pigments may include sulfates of alkali metals such as barium sulfate, etc., carbonates of alkaline each metals such as calcium carbonate, etc., silicas such as fine powdery siliconic acid and synthetic silicate, calcium silicate, alumina, alumina hydrate, titanium oxide, zinc oxide, talc, clay, etc. The white pigment may be preferably barium sulfate, calcium carbonate, titanium oxide, more preferably barium sulfate.

The content of the above opacifying pigment depends on the resin which is the matrix in which it is mixed, the film formation conditions, the properties and the particle size of the pigment mixed, but may be preferably 3 to 30% by weight.

Also, on the opaque resin sheet surface, application of emboss and coloration which are applied on a transparent resin sheet, or formation of a multiple layer can be used as the means for prevention of forging or falsifying of the card and discrimination when the photographic element of the present invention is embodied as a card for ID card, etc.

When a card is to be constituted, a magnetic recording layer may be also provided on said card.

FIG. 1 shows an example of a particularly suitable support constitution for ID card. In the same FIG. 11 is a white polyethylene terephthalate sheet, 12 a white polyethylene having adhesion ability, 13 a white polyethylene terephthalate film and 14 a polypropylene type synthetic paper, of which the support is constituted. In a more preferred embodiment, it is recommendable to use Yupo (trade name, manufactured by Oji Yuka Synthetic Paper) which is a synthetic paper containing voids as the polypropylene type synthetic paper 14. In FIG. 1, 3 is a photographic emulsion layer which becomes the image forming layer. 4 is a writing layer. In the example shown in the figure, the polypropylene type synthetic paper 14 is made to have a thickness of 80 μm, and on one surface thereof is further provided a writing layer 4 including clay as the writing layer 4 for improvement of writability and printability. In formation of the support shown in the drawing, onto such synthetic paper 14 (Yupo) was extruded a dissolved polyethylene containing 8% titanium oxide to form a white polyethylene 12 functioning as the adhesive, through which was plastered a white polyethylene terephthalate film 11 of 175 μm with a transmission density of 1.35. On the surface opposite to the surface where the white polyethylene terephthalate film 11 is plastered is printed a pattern 2, and further a white polyethylene terephthalate film 13 applied with subbing working of 175 μm with a transmission density of 1.35 is plastered thereon with a dissolved polyethylene 12 containing 8% extruded therebetween. The layers from 13 to 14 in the figure constitute the support or substrate 1 of the present invention.

Also, by working the above writing layer 4, supplementing information may be also listed by printing.

As described above, as a preferred embodiment of the photographic element of the present invention, there is ID card, and in that case, said card can be formed by forming the protective coating layer according to the present invention on the image member having a desired information carried as the image. Such ID card has a hardness to some extent against the physical pressure from outside, and should preferably be one which is not damaged by flexing, etc. during carrying, particularly an opaque resin sheet having a desired hardness.

In the photographic element according to the present invention, the image member having a photographic image layer can be constituted by forming an image on any desired light-sensitive photographic material. For example, it can be formed by applying predetermined processing steps on silver halide light-sensitive materials for black-and-white or color, various diffusion transfer type light-sensitive materials, diazo light-sensitive materials, electrophotographic image recording materials, etc.

In the photographic element according to the present invention, the photographic image layer should be preferably a layer containing a hydrophilic polymeric compound, which forms the protective coating layer with the active energy ray curable composition according to the present invention on the photographic image layer containing said hydrophilic polymeric compound.

In the present invention, as the hydrophilic polymeric compound to be used in the photographic image layer carrying the image, gelatin, gelatin derivatives, graft polymers of gelatin with other polymers, other proteins, sugar derivatives and cellulose derivatives can be used, and also synthetic hydrophilic polymeric substances such as homopolymers or copolymers can be used. Among them, the effect of the present invention is marked when at least gelatin is used.

As gelatin, for example, lime-treated gelatin can be used, or otherwise acid-treated gelatin or oxygen-treated gelatin as described in Bull. Soc. Sci. Phot. Japan, No. 16, p. 30 (1966) may be also used. Also, hydrolyzates or enzyme decomposed products of gelatin can be used. As the gelatin derivatives, those obtained by allowing various compounds such as acid halide, acid anhydride, isocyanates, bromoacetic acid, alkanesultones, vinylsulfoneamides, maleinimide compounds, polyalkylene oxides, epoxy compounds, etc. can be used. Specific examples of them are disclosed in U.S. Pat. Nos. 2,614,928, 3,132,945, 3,186,846 and 3,312,553, U.K. Patents Nos. 861,414 and 1,033,189, 1,005,784 and Japanese Patent Publication No. 26845/1967.

As the protein as alternative hydrophilic polymeric compound for gelatin or which can be used in combination with gelatin, albumin, casein, etc. may be included; as the cellulose derivative, hydroxyethyl cellulose, carboxymethyl cellulose, sulfuric acid ester of cellulose, etc. may be included; and as the sugar derivative, sodium alginate and starch derivatives can be preferably used.

Graft polymers of gelatin with other polymers can be also used, and as such polymers, those having homo- or copolymers of vinyl monomers such as acrylic acid, methacrylic acid, derivatives thereof such as esters, amides, etc., acrylonitrile, styrene, etc. copolymers grafted onto gelatin can be used. Particularly, polymers having compatibility with gelatin to some extent, such as graft polymers with polymers of acrylic acid, acrylamide, methacrylamide, hydroxyalkyl methacrylate, etc. are preferable. These examples are described in U.S. Pat. Nos. 2,763,625, 2,831,767, 2,956,884, etc.

In place of gelatin or in combination with gelatin, synthetic hydrophilic polymeric substances can be used, and representative synthetic hydrophilic polymeric substances are homo- or copolymers such as polyvinyl alcohol, polyvinyl alcohol partial acetal, poly-N-vinylpyrrolidone, polyacrylic acid, polymethacrylic acid, polyacrylamide, polyvinyl imidazole, polyvinyl pyrazole, etc., as described in, for example, Germal Patent Publication (OLS) No. 2,312,708, U.S. Pat. Nos. 3,620,751 and 3,879,205, and Japanese Patent Publication No. 7561/1968.

When gelatin is used as the hydrophilic polymeric compound, jelly strength of gelatin is not limited, but a jelly strength of 250 g or higher (value measured by the Baggy method) is preferable.

The photographic image layer constituting the photographic element of the present invention or other hydrophilic colloidal layers formed as desired can be hardened by use of one or two or more kinds of film hardeners for crosslinking binder (or protective colloid) molecules and enhancing the film strength. Film hardeners can be added in amounts so that film hardening may be effected to the extent such that no film hardening agent is required in the processing liquor, but it is also possible to add a film hardener into the processing liquor.

Further, in the above photographic image layer, or other hyrophilic colloidal layers, plasticizers can be added for enhancing flexibility.

The photographic image layer can be obtained by coating a light-sensitive layer of light-sensitive material, etc. or an image-receiving layer on the support as described above such as water-proof worked baryta paper, white opaque resin sheet support, a support coated on the back with a black-and-white light shielding layer or a support of transparent resin sheet, etc., and treating them by a predetermined treatment.

As the image-forming layer of the photographic element according to the present invention, for example, a posi-type light-sensitive silver halide material can be suitably used. In this case, the support may be either opaque or transparent.

In practicing the present invention, when employing thus a direct positive image forming silver halide emulsion as the emulsion to be used for the light-sensitive material constituting the layer for carrying the image, for example, an internal latent image type silver halide emulsion can be used. In that case, the emulsion, the additives, the color forming couplers, the fogging processing, the developing processing step, etc. can be practiced in the same manner as described in Japanese Patent Publication No. 229133/1987, p. 37, line 15 to p. 62, line 1.

EXAMPLES

The present invention is described below in detail, but the present invention is not limited to these embodiments.

As described above in FIG. 1, on a support comprising two polyester layers 11 and 13 of 175 μm applied with the surface treatment, and adhered with a polypropylene type synthetic paper 14 of 80 μm applied on the back with a writable coating, 9 layers from the red-sensitive emulsion layer to the protective layer as shown below were coated according to simultaneous coating method and dried to prepare a color print sample.

Red-sensitive emulsion layer (First layer)

While a 2.0% inactive gelatin solution was maintained at 50° C. under stirring, the solutions A and B shown below were injected at the same time over 3 minutes. After 10 minutes, the solution C shown below was injected over 3 minutes. After aging for 40 minutes, excessive salts were removed by the precipitation water washing method, followed by addition of the solutions D and E, to have a silver chlorobromide comprising 95 mole % AgCl and 5 mole % of AgBr laminated on the back surface. Excessive water-soluble salts were removed again by the precipitation water washing method, and a small amount of gelatin was added to be dispersed in the mixture.

| | | |
|---|---|---|
| Solution A | Pure water | 500 ml |
| | NaCl | 40 g (137 mole %) |
| | KBr | 8.9 g (15 mole %) |
| | KI | 0.4 g (0.5 mole %) |
| Solution B | Pure water | 660 ml |
| | $AgNO_3$ | 85 g |
| Solution C | Pure water | 300 ml |
| | KBr | 50.6 g (85 mole %) |
| Solution D | Pure water | 1500 ml |
| | NaCl | 20 g (114 mole %) |
| | KBr | 1.8 g (5 mole %) |
| Solution E | Pure water | 500 ml |
| | $AgNO_3$ | 51 g (0.3 mole %) |

Then, into the silver halide emulsion were suitably added a sensitizing dye (D-1), a sensitizing dye (D-4), a liquid containing 2,5-dioctylhydroquinone and a cyan coupler (CC-1) protect dispersed with dibutyl phthalate, 4-hydroxy-6-methyl-1,3,3a,7-tetrazaindene, 1-phenyl-5-mercaptotetrazole, further gelatin, a coating aid (S-1). Coating was performed to a coated silver amount of 0.4 g/m$^2$.

First intermediate layer (Second layer)

A gelatin liquid containing 2,5-dioctylhydroquinone and a UV-ray absorber Tinuvin 328 (manufactured by Ciba-Geigy) dispersed in dioctyl phthalate, and a coating aid (S-1) was prepared and coated to a coated amount of Tinuvin 328 of 0.15 g/m$^2$.

Green-sensitive emulsion layer (Third layer)

Silver halide grains were prepared similarly as the red-sensitive emulsion. To this were added suitably a sensitizing dye (D-2), a liquid containing 2,5-dioctylhydroquinone and a magenta coupler (MC-1) protect dispersed with dibutyl phthalate, 4-hydroxy-6-methyl-1,3,3a,7-tetrazaindene, 1-phenyl-5-mercaptotetrazole, further gelatin and a coating aid (S-2). Coating was performed to a coated silver amount of 0.4 g/m$^2$.

Second intermediate layer (Fourth layer)

Coating was performed according to the same recipe as in the first intermediate layer except for the coated amount of Tinuvin 328 of 0.2 g/m$^2$.

Yellow filter layer (Fifth layer)

A 2,5-dioctylhydroquinone liquid dispersed in a yellow colloidal silver prepared by oxidation under an alkaline weak reducing agent (after neutralization, the weak reducing agent was removed by the Noodle water washing method) and dioctyl phthalate, a coating aid (S-2) and a film hardener (H-1) were added (immediately before coating), and the mixture was coated to a coated silver amount of 0.15 g/m$^2$.

Third intermediate layer (Sixth layer)

Coating was performed according to the same recipe as in the first intermediate layer except for the coated amount of Tinuvin 328 of 0.15 g/m$^2$.

Blue-sensitive layer (Seventh layer)

While a 1.5% inactive gelatin solution was maintained at 60° C. under stirring, the solutions A' and B' shown below were injected at the same time over 15 minutes. After 15 minutes, the solution C' shown below was injected over 2 minutes, and one minute later, hypo was added in an amount corresponding to 3 mg/Ag, followed further by aging for 40 minutes. When the composition was analyzed by sampling, it was found to be a silver chlorobromide comprising 4 mole % of AgCl, 96 mole % of AgBr and 2 mole % of AgI.

After removal of excessive salts by the precipitation water washing method, the solutions D' and E' shown below were added to have a surface layer of 97 mole % of AgCl and 3 mole % of AgBr laminated, and then again excessive salts were removed by the precipitation water washing method, followed by addition of gelatin for dispersion.

| | | |
|---|---|---|
| Solution A' | Pure water | 1000 ml |
| | NaCl | 76 g |
| | KBr | 17 g |
| | Hexachloroiridium (III) acid salt | $2 \times 10^{-5}$ g |
| Solution B' | Pure water | 1000 ml |
| | $AgNO_3$ | 169.9 g |
| Solution C' | Pure water | 800 ml |
| | KBr | 103 g |
| | KI | 3.3 g |
| Solution D' | Pure water | 500 ml |
| | $AgNO_3$ | 51 g |
| Solution E' | Pure water | 500 ml |
| | NaCl | 25.8 g |
| | KBr | 1.1 g |

By use of the silver halide emulsion together with a liquid containing a sensitizing dye (D-3) and a yellow coupler (YC-1) dispersed in dioctyl phthalate, and a liquid containing 2-mercaptobenzothiazole, 4-hydroxy-6-methyl-1,3,3a,7-tetrazaindene, gelatin, a coating aid (S-3) and a film hardener (H-1) (added immediately before coating), coating was performed to a coated silver amount of 0.5 g/m$^2$.

Fourth intermediate layer (Eighth layer)

According to the same recipe as in the first intermediate layer, coating was performed to a coated amount of Tinuvin 328 of 0.3 g/m$^2$. However, a film hardener (H-1) was added just before coating.

Protective layer (Ninth layer)

By use of a gelatin solution containing a noncrystalline silica with a mean grain size of 3 μm, a coating aid (S-3) and a film hardener (H-1) (added just before coating), coating was performed to a coated gelatin amount of 1.0 g/m$^2$.

Cyan coupler (CC-1)

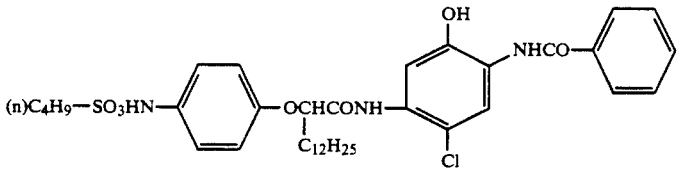

Magenta coupler (MC-1)

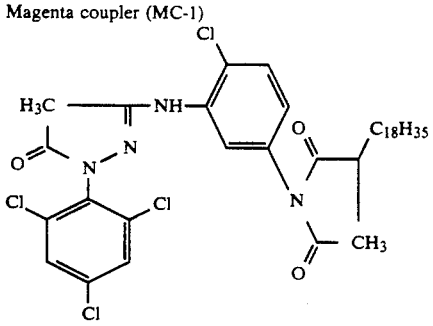

Yellow coupler (YC-1)

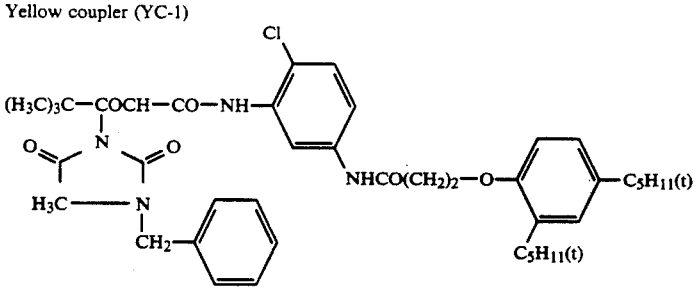

Sensitizing dye (D-1)

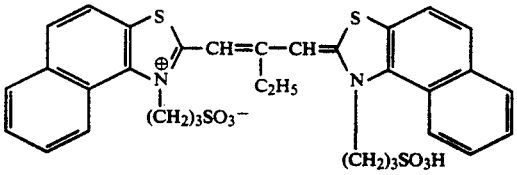

Sensitizing dye (D-2)

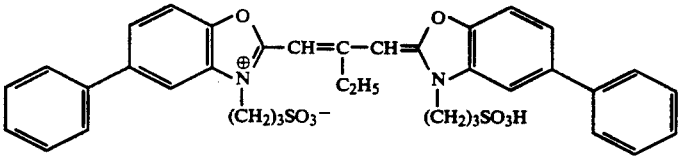

Sensitizing dye (D-3)

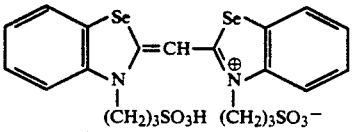

Sensitizing dye (D-4)

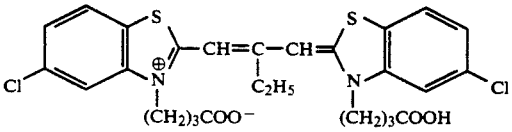

-continued

Coating aid (S-1)

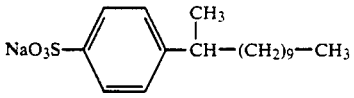

Coating aid (S-2)

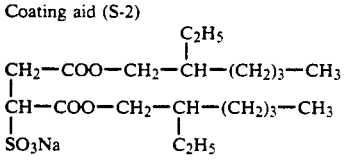

Coating aid (S-3)

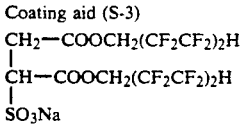

H-1: 1,3,5-triglycidyl isocyanurate

Specific photographic processing conditions in this Example are as shown below.

| Processing steps (processing temperature and processing time) | | |
|---|---|---|
| [1] Dipping (color developing solution) | 38° C. | 8 sec. |
| [2] Fogging exposure | 10 sec. at 1 lux | |
| [3] Color developing | 38° C. | 2 min. |
| [4] Bleach-fixing | 35° C. | 60 sec. |
| [5] Stabilizing processing | 25-30° C. | 1 min. 30 sec. |
| [6] Drying | 75-80° C. | 1 min. |
| Processing liquor composition | | |
| (Color developing solution) | | |
| Benzyl alcohol | | 10 ml |
| Ethylene glycol | | 15 ml |
| Potassium sulfite | | 2.0 g |
| Potassium bromide | | 1.5 g |
| Sodium chloride | | 0.2 g |
| Potassium carbonate | | 30.0 g |
| Hydroxylamine sulfate | | 3.0 g |
| Polyphosphoric acid (TPPS) | | 2.5 g |
| 3-Methyl-4-amino-N-ethyl-N-(β-methanesulfonamidoethyl)-aniline sulfate | | 5.5 g |
| Fluorescent brightener (4,4'-diamino stilbenzsulfonic acid derivative) | | 1.0 g |
| Potassium hydroxide | | 2.0 g |
| (made up to one liter with addition of water, and adjusted to pH 10.20) | | |
| (Bleach-fixing solution) | | |
| Ferric ammonium ethylenediaminetetraacetate dihydrate | | 60 g |
| Ethylenediaminetetraacetic acid | | 3 g |
| Ammonium thiosulfate (70% solution) | | 100 ml |
| Ammonium sulfite (40% solution) | | 27.5 ml |
| (adjusted to pH 7.1 with potassium carbonate or glacial acetic acid, and made up to total amount of one liter) | | |
| (Stabilizing solution) | | |
| 5-Chloro-2-methyl-4-isothiazoline-3-one | | 1.0 g |
| Ethylene glycol | | 10 g |
| 1-Hydroxyethylidene-1,1'-diphosphonic acid | | 2.5 g |
| Bismuth chloride | | 0.2 g |
| Magnesium chloride | | 0.1 g |
| Ammonium hydroxide (28% aqueous solution) | | 2.0 g |
| Sodium nitrilotriacetate | | 1.0 g |
| (made up to total amount of one liter, and adjusted to pH 7.0 with ammonium hydroxide or sulfuric acid) | | |

The stabilizing processing was performed according to the countercurrent system consisting of two tanks.

The image members applied with the above developing processing was controlled in humidity by blowing wind with different humidities thereagainst to the water contents shown in Table 1. More specifically, the sample previously controlled over day and night at a temperature of 23° C. and a humidity of RH 80% was exposed to the winds of 23° C. each having the humidity of 0% RH, 10% RH, 20% RH, 30% RH, 40% RH, 55% RH and 70% RH for 5 minutes, to control the humidity respectively to water contents of 5.0 Wt. %, 8.0 Wt. %, 13.0 Wt. %, 15.0 Wt. %, 17.0 Wt. %, 19.0 Wt. %, 25.0 Wt. %, followed immediately by coating of the energy ray curable compositions or comparative compositions shown in Table 1 to obtain Samples 1 to 14.

In the examples, the water content was measured as described below. By use of a conventional IR-red water meter, for example, a table digital water meter IRA H110 manufactured by CHINO Seisakusho, a calibration curve was previously prepared and the water content of the layer carrying the image before coating of an energy ray curable resin is measured. The calibration curve can be prepared according to the procedure shown below.

A support having a layer carrying an image provided thereon and a support from which the layer carrying the image was peeled off are controlled in humidity under the air conditioning conditions with different humidities for 2 days (humidity conditions are respectively 0% RH, 20% RH, 55% RH and 80% RH). This sample is applied to an IR-ray water meter, and the measured value is read. On the other hand, the weights of these samples are weighed, and then these samples are dried at 120° C. for 3 hours for measurement of the weights. From the difference in weight before and after drying, the water content per unit area is determined. The value obtained by subtracting the water content of only the support from the water content in the support having the image layer provided thereon is defined as the water content of the layer carrying the image, and the water content is measured from the above formula. By taking correspondence of the water content to the measured value by IR-ray water meter, a calibration curve is prepared.

The color print sample which is the image member obtained as described above was coated with the composition as described below, followed by curing, to provide a protective layer thereon.

Coating and curing of the composition were conducted by coating of the coating compositions (1) to (6) according to the present invention shown below or the acrylic composition as Comparative example to a coated amount of 10 g/m$^2$, and curing the composition by irradiation of UV-ray under a high pressure mercury lamp of 60 W/cm$^2$ at a distance of 10 cm for 4 seconds so as to cure the coated composition. The temperature just before irradiation of UV-ray was made 20° C.

| | |
|---|---|
| (Comparative composition) | |
| Acrylic resin composition: | |
| Pentaerythritol triacrylate | 21 parts |
| Pentaerythritol tetraacrylate | 9 parts |
| Urethane acrylate (Unidic 17-849, manufactured by Dainippon Ink Kagaku Kogyo) | 70 parts |
| Benzoin ethyl ether | 5 parts |
| (UV-curable composition) | |
| Epoxy type resin composition (1): | |
| Bisphenol A diglycidyl ether | 15 parts |
| 3,4-Epoxycyclohexymethyl-3,4-epoxy-cyclohexane carboxylate | 65 parts |
| 1,4-Butanediol diglycidyl ether | 20 parts |
| Fluorine type surfactant | 1 part |
| Aromatic sulfonium salt type UV initiator | 5 parts |
| Epoxy type resin composition (2): | |
| Side chain type bispenol A diglycidyl ether | 15 parts |
| 3,4-Epoxycyclohexyl methyl-3,4-epoxycyclohexane carboxylate | 70 parts |
| Trimethylolpropane triglycidyl ether | 15 parts |
| Fluorine type surfactant | 2 parts |
| Aromatic sulfonium salt type UV initiator | 6 parts |
| Epoxy type resin composition (3): | |
| Side chain type bisphenol A glycidyl ether | 10 parts |
| 3,4-Epoxycyclohexylmethyl-3,4-epoxycyclohexane carboxylate | 65 parts |
| Sorbitol polyglycidyl ether | 25 parts |
| Fluorine type surfactant | 1 part |
| Aromatic sulfonium salt type UV initiator | 6 parts |
| Epoxy type composition (4): | |
| Bisphenol F diglycidyl ether | 15 parts |
| Bis(3,4-epoxycyclohexylmethyl) adipate | 20 parts |
| 3,4-Epoxycyclohexylmethyl-3,4-epoxy-cyclohexane carboxylate | 50 parts |
| Pentaerythritol polyglycidyl ether | 15 parts |
| Silicone type surfactant | 2 parts |
| Aromatic sulfonium salt type UV initiator | 5 parts |
| Epoxy type composition (5): | |
| Hydrogenated bisphenol A diglycidyl ether | 30 parts |
| 3,4-Epoxycyclohexylmethyl-3,4-epoxy-cyclohexane carboxylate | 40 parts |
| Bis(3,4-epoxycyclohexylmethyl) adipate | 15 parts |
| Trimethylolpropane triglycidyl ether | 15 parts |
| Silicone type surfactant | 3 parts |
| Aromatic sulfonium salt type UV initiator | 5 parts |
| Epoxy type composition (6): | |
| Phenol novolac type polyglycidyl ether | 10 parts |
| 3,4-Epoxycyclohexylmethyl-3,4-epoxy-cyclohexyane carboxylate | 60 parts |
| Polyglycerine glycidyl ether | 25 parts |
| Higher fatty alcohol glycidyl ether | 5 parts |
| Fluorine type surfactant | 1 part |
| Aromatic iodonium salt type UV initiator | 4 parts |

Evaluation of sample

The samples obtained as described above were evaluated according to the following methods.

1. Adhesion to photographic image layer:

Adhesion (1) to (4) were examined as follows.

(1) Cellotape (manufactured by Nichiban) was plastered strongly onto the surface of the cured protected coating layer, and after the Cellotape was peeled off quickly from the surface, the peeled state was observed.

(2) The protected coating layer was damaged with a cutter at an angle of 90°, and the adhesion at the site with the photographic image layer was examined by the same method as in the item (1).

(3) A sample having the cured coating layer was immersed in tap water of 20° C. over day and night, and the adhesion at the site with the photographic image layer was examined by the same method as in the item (1).

(4) A sample having the cured coating layer was immersed in tap water of 20° C. over day and night, and the adhesion at the site with the photographic image layer was examined by the same method as in the item (2).

Evaluation result of adhesion is shown as the residual % of the area of the Cellotape adhered and written in Table 1. If this is 80% or higher, adhesion is practically tolerable.

As is apparent from Table 1, all the samples according to the present invention exhibited excellent results in the respective adhesion tests of (1) to (4). Particularly, 90% or more of residual area was given even under severe conditions of damaging with a cutter of (2), and also a value of approximately 100% or 90% even at the worst was given in the water resistant tests of (4) and (3), whereby it can be understood that adhesion is extremely excellent under bad conditions.

Also, separately, on a support laminated with polyethylene on an original paper for photography, the first layer to the ninth layer as described above were coated to form an image forming member. However, as the film hardener of the protective layer (the ninth layer), in place of the above (H-1), the following compound was used.

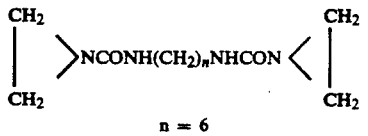

(corresponds to the exemplary compound (41) disclosed in Japanese Unexamined Patent Publication No. 229133/1987).

The image member obtained was applied with the above photographic treatment, coated with the epoxy type composition (1) and cured by irradiation of UV-ray. However, the curing was effected at 23° C. (normal temperature) without heating.

The photographic element thus obtained was evaluated, and the adhesion was similar as the sample according to the present invention, but sensitivity was found to be remarkably lower as compared with the sample of the present invention. Even by use of a specific film hardener for improvement of adhesion, if the temperature control during curing is outside the scope of the present invention, it can be understood that no sufficient effect in photographic performance can be obtained.

TABLE 1

| Sample | Water content wt. % of layer carrying image | Energy ray curable composition or comparative composition | Adhesion (1) | (2) | (3) | (4) | |
|---|---|---|---|---|---|---|---|
| 1 | 5.0 | Epoxy type composition (1) | 100 | 100 | 100 | 100 | This inv. |
| 2 | 8.0 | Epoxy type composition (1) | 100 | 100 | 100 | 100 | This inv. |
| 3 | 13.0 | Epoxy type composition (1) | 100 | 100 | 100 | 100 | This inv. |
| 4 | 15.0 | Epoxy type composition (1) | 100 | 100 | 100 | 100 | This inv. |
| 5 | 17.0 | Epoxy type composition (1) | 100 | 100 | 100 | 100 | This inv. |
| 6 | 19.0 | Epoxy type composition (1) | 100 | 100 | 100 | 100 | This inv. |
| 7 | 25.0 | Epoxy type composition (1) | 50 | 0 | 50 | 0 | Compara. |
| 8 | 13.0 | Epoxy type composition (2) | 100 | 100 | 100 | 100 | This inv. |
| 9 | 13.0 | Epoxy type composition (3) | 100 | 100 | 100 | 100 | This inv. |
| 10 | 13.0 | Epoxy type composition (4) | 100 | 100 | 100 | 100 | This inv. |
| 11 | 13.0 | Epoxy type composition (5) | 100 | 90 | 100 | 95 | This inv. |
| 12 | 13.0 | Epoxy type composition (6) | 100 | 95 | 100 | 90 | This inv. |
| 13 | 13.0 | Acrylic resin composition | 80 | 60 | 80 | 60 | Compara. |
| 14 | 25.0 | Acrylic resin composition | 40 | 0 | 50 | 0 | Compara. |

As described above, according to the present invention, a photographic element which is a photographic element having a protective coating layer formed thereon by curing with active energy ray, having good adhesion of the image forming layer, etc., and also having good water resistance can be provided. Also, there can be provided a method for preparing simply and inexpensively such photographic element by active energy ray irradiation of low energy.

We claim:

1. A process for preparing a photographic element, comprising:

coating a photographic image layer on a support, which image layer having a photographic emulsion layer, forming an image on said photographic image layer by an exposure, processing said image, said processing including developing and fixing, drying said photographic image layer so that a water-content of said photographic image layer is between 5.0 and 20.0% by weight, coating a radiation-curable composition on a said emulsion layer, curing said composition by an irradiation of ultra-violet ray to make a protective layer, wherein said composition consists essentially of at least one prepolymer having at least two epoxy groups in a molecule, at least one of polymerization initiator, and a surfactant, said prepolymer being selected from the group consisting of aromatic epoxy prepolymer, alicyclic epoxy prepolymer, and aliphatic epoxy prepolymer, said aromatic epoxy prepolymer being polyglycidyl ethers of polyhydric phenols or alkylene oxide adducts of the polyhydric phenol, said alicyclic epoxy prepolymer being selected from the group consisting of polyglycidyl ethers of polyhydric alcohols having at least two alicyclic rings and cyclohexane oxide or cyclopentene oxide-containing compounds obtained by epoxidization of cyclohexene or cyclopentene ring containing compound with an oxidizing agent, said aliphatic epoxy prepolymer being selected from the group consisting of polyglycidyl ethers of aliphatic polyhydric alcohols or alkylene oxide adducts of the aliphatic polyhydric alcohols, homopolymers and copolymers of polyglycidyl esters, glycidyl acrylates of glycidyl methacrylates of aliphatic long chain polybasic acids, and said polymerization initiator is a compound represented by the formula:

$$[R^1_aR^2_bR^3_cR^4_dZ]^{+m}[MX_{n+m}]^{-m}$$

wherein cation is onium; Z is at least one selected from the group consisting of S, Se, Te, P, As, Sb, Bi, O, a halogen or N=N; $R^1$, $R^2$, $R^3$ and $R^4$ are organic groups which may be either identical or different; a, b, c and d are each integer of 0 to 3, and a+b+c+d is equal to the valence of Z; M is a metal or a metalloid which is the center atom of the halide complex; X is a halogen; m is the net charges of the halide complex ion; and n is the number of halogen atoms in the halide complex ion; and said initiator is present in an amount of 0.1 to 15 parts by weight based on 100 parts by weight of said prepolymer.

2. The process according to claim 1, wherein the protective layer is coated as the layer remotest from the support.

3. The process according to claim 1, wherein the coating of the protective layer to a thickness of 0.1 $\mu$ to 30 $\mu$.

4. The process according to claim 3, wherein the coating thickness of the protective is 1 $\mu$ to 15 $\mu$.

5. The process according to claim 1, wherein the prepolymer is an epoxy resin which is formed into a polymer or crosslinked by irradiation of an energy ray in the presence of the polymerization initiator.

6. The process according to claim 1, wherein the prepolymer is a combination of an aromatic epoxy resin, an alicyclic epoxy resin and an aliphatic epoxy resin.

7. The process according to claim 1, wherein the polymerization initiator is a compound which can liberate a substance capable of initiating cation polymerization by irradiation of the active energy ray.

8. The process according to claim 7, wherein the polymerization initiator is a group of complex salts which are onium salts liberating Lewis acid having polymerization initiation ability by ultraviolet irradiation.

9. The process according to claim 1, wherein the $MX_{n+m}$ in the formula is at least one selected from the group consisting of tetrafluoroborate (BF4), hexafluorophosphate ($PF_6$), hexafluoroantimonate ($SbF_6$), hexafluoroarsenate ($AsF_6$), hexachloroantimonate ($SbCl_6$), anions of the formula $MX_n(OH)$, perchlorate ion ($ClO_4$), trifluoromethyl sulfite ion ($CF_3SO_3$), fluorosulfonic acid ion ($FSO_3$), toluenesulfonic acid anion and trinitro-benzenesulfonic acid anion.

* * * * *